US008318648B2

(12) United States Patent
Patil

(10) Patent No.: US 8,318,648 B2
(45) Date of Patent: Nov. 27, 2012

(54) POLYETHER-CONTAINING LUBRICANT BASE STOCKS AND PROCESS FOR MAKING

(75) Inventor: Abhimanyu Onkar Patil, Westfield, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 329 days.

(21) Appl. No.: 12/653,522

(22) Filed: Dec. 15, 2009

(65) Prior Publication Data

US 2011/0143983 A1 Jun. 16, 2011

(51) Int. Cl.
*C10M 107/34* (2006.01)
*C07C 41/00* (2006.01)

(52) U.S. Cl. ..... 508/579; 568/613

(58) Field of Classification Search ..... 508/304, 508/579; 568/300

See application file for complete search history.

(56) References Cited

U.S. PATENT DOCUMENTS

| | | | | |
|---|---|---|---|---|
| 3,149,178 | A | 9/1964 | Hamilton et al. | |
| 3,382,055 | A | 5/1968 | Jacobson et al. | |
| 3,835,166 | A | 9/1974 | Gipson et al. | |
| 4,299,712 | A | 11/1981 | Hoke | |
| 4,481,123 | A | 11/1984 | Hentschel et al. | |
| 4,943,383 | A * | 7/1990 | Avery et al. | 508/304 |
| 4,992,189 | A | 2/1991 | Chen et al. | |
| 5,017,299 | A | 5/1991 | Gutierrez et al. | |
| 5,068,048 | A | 11/1991 | Chen et al. | |
| 5,068,487 | A | 11/1991 | Theriot | |
| 5,186,851 | A | 2/1993 | Gutierrez et al. | |
| 6,087,307 | A * | 7/2000 | Kaminski et al. | 508/223 |
| 6,548,724 | B2 | 4/2003 | Bagheri | |
| 6,555,635 | B2 | 4/2003 | Markel | |
| 6,824,671 | B2 | 11/2004 | Goze et al. | |
| 2009/0156874 | A1 | 6/2009 | Patil et al. | |

FOREIGN PATENT DOCUMENTS

| | | | |
|---|---|---|---|
| JP | 50133205 | | 4/1974 |
| JP | 2001-031716 | | 7/1999 |
| JP | 2005053848 | | 8/2003 |
| JP | 2005225788 | | 2/2004 |
| WO | 8912651 | A2 | 12/1989 |
| WO | WO 9929743 | | 6/1999 |
| WO | WO 2007/011459 | A1 | 1/2007 |
| WO | WO 2007/011462 | A1 | 1/2007 |
| WO | WO 2007/011973 | A1 | 1/2007 |

OTHER PUBLICATIONS

Hafren, et al., "Direct Organocatalytic Polymerization from Cellulose Fibers", Macromol. Rapid Commun., vol. 26, pp. 82-86 (2005).

Song, et al., "Derivatization of Propene/Methyloctadiene Copolymers: A Flexible Approach to Side-Chain-Functionalized Polypropenes", J. Polym. Sci. Polym. Chem., vol. 40, pp. 1484-1497 (2002).

Suzuki, et al., "Synthesis and Functionalization of Poly(ethylene-*co*-dicyclopentadiene)", Journal of Applied Polymer Science, vol. 72, pp. 103-108 (1999).

Li et al., "Scandium-Catalyzed Copolymerization of Ethylene with Dicyclopentadiene and Terpolymerization of Ethylene, Dicyclopentadiene, and Styrene", Macromolecules, vol. 38, pp. 6767-6769 (2005).

Hermann, et al., Angew. Chem. Int. Ed. Engl., vol. 30, No. 12, pp. 1638-1641 (1991).

Van Vliet, et al., "Methyltrixorhenium-catalysed epoxidation of alkenes in trifluoroethanol", Chem. Commun., pp. 821-822 (1999).

Neimann, et al., "Electrophilic Activation of Hydrogen Peroxide: Selective Oxidation Reactions in Perfluorinated Alcohol Solvents", Org. Letters, vol. 2, No. 18, pp. 2861-2863 (2000).

* cited by examiner

*Primary Examiner* — Ellen McAvoy
*Assistant Examiner* — Taiwo Oladapo
(74) *Attorney, Agent, or Firm* — Robert A. Miglioini

(57) ABSTRACT

A lubricant base stock is provided. The base stock is a polyether of a plurality of epoxidized olefin monomeric units. The polyether has 30 carbon atoms or more. There is also a process for making a polyether.

20 Claims, No Drawings

POLYETHER-CONTAINING LUBRICANT BASE STOCKS AND PROCESS FOR MAKING

FIELD

The present disclosure relates to polyether-containing lubricant base stocks and a process for making. The present disclosure also relates to a process for oligomerizing or co-oligomerizing epoxide macromers.

BACKGROUND

Synthetic hydrocarbons have been used as lubricant components for automotive, aviation, and industrial applications. Poly-α-olefins (PAOs, polyalphaolefins) are synthetic hydrocarbons that have been used as lubricant base oils. PAOs exhibit desirable flow properties at low temperatures, high thermal and oxidative stability, low evaporation losses at high temperatures, high viscosity index, good friction behavior, good hydrolytic stability, and good erosion resistance. PAOs are relatively nontoxic and are miscible with a variety of conventional base stocks, including mineral oils, Group I-III and Group III+ oils, GTL fluids and esters. Consequently, PAOs are suitable for use in engine oils, compressor oils, hydraulic oils, gear oils, and greases.

PAOs have been commercially manufactured by catalytic oligomerization of olefins. The manufacturing process generates a distillate byproduct that contains mostly light $C_8H_{16}$ to $C_{30}H_{60}$ oligomers (averaging $C_{20}H_{40}$ or less) exhibiting a relatively low average molecular weight of about 280 or less. The distillate byproducts are usually recycled to produce more PAO product. The distillate byproduct typically has a significant incidence of long chain branching and highly substituted double bonds (tri- or tetra-substituted olefins). Highly substituted olefins usually exhibit lower reactivity than less substituted olefins. Recycle of highly substituted olefins and/or olefins with long chain branching can negatively impact physical properties of the final lube product, such as viscosity index (VI), volatility, and thermal-oxidative stability.

Lubricants have been identified as a critical feature for future lubricants in automotive applications for the future. To provide enhanced fuel economy while maintaining or improving other performance features for lubricants, base stocks that exhibit lower friction coefficients are needed.

For automotive engine lubricant formulations, it is generally preferred to have lower viscosity fluids, e.g., below 10 cSt. Lower viscosity is known to impart lower viscous drag thus offering better energy efficiency or fuel economy. Both low viscosity and high viscosity fluids are useful in industrial lubricant formulations to yield different ISO vis grad lubricants. For industrial lubricant formulations, it is generally important to use fluids of high Viscosity Index (VI) and high hydrolytic stability.

For both engine and industrial lubricant applications, it is important to have a lubricant formulation with a low friction coefficient. Fluids with low friction coefficients exhibit low frictional loss during lubrication. Low frictional loss is critical for improved energy or fuel efficiency of formulated lubricants.

Friction coefficients can be measured by a High Frequency Reciprocating Rig (HFRR) test. The test equipment and procedure are similar to the ASTM D6079 method except the test oil temperature is raised from 32° C. to 195° C. at 2° C./minute, 400 g load, 60 Hz frequency, and 0.5 mm stroke length or 400 g load, 60 Hz frequency at constant temperature, such as 100° C. or 60° C. The test can measure average friction coefficient and wear volume.

It would be desirable to have a process for making polar PAOs in which distillate byproducts could be processed and converted to polar PAOs. It would further be desirable to have a process for making polar PAOs in which recycle of distillate byproduct could be avoided. It would be further yet desirable to have a base stock that exhibits a low coefficient of friction.

SUMMARY

According to the present disclosure, there is a lubricant base stock. The base stock is a polyether of a plurality of epoxidized olefin monomeric units. The polyether has 30 carbon atoms or more.

The epoxidized macromer units is an epoxidized macromer having between 18 to 40 carbon atoms derived from ethylene, propylene or α-olefins, and combinations of the foregoing. The epoxidized olefin monomeric units are derived from one or more internal olefins. Alternatively, the epoxidized olefin monomeric units are derived from one or more olefins including 1-hexene, 1-octene, 1-nonene, 1-decene, 1-undecene, 1-dodecene, 1-tetradecene, or 1-octadecene. Still further, the epoxidized olefin monomeric unit is a low molecular weight oligomer prepared via a metallocene catalytic reaction. The low molecular weight oligomer is a dimer of 1-decene, 1-decene, 1-hexene, 1-tetradecene or mixtures thereof.

The polyether includes 30 carbon atoms to 1000 carbon atoms. Preferably, the base stock exhibits a kinematic viscosity at 100° C. of 3 to 600 cSt. More preferably, the base stock exhibits a kinematic viscosity at 100° C. of between 3 to 8 cSt.

A process for making polyether comprising oligomerizing in the presence of a Lewis acid catalyst an amount of one or more epoxidized olefins to an extent that the polyether has 30 or more carbon atoms.

Preferably, the Lewis acid includes $AlCl_3$, $BF_3$, $AlBr_3$, $TiCl_3$, or $TiCl_4$, or Lewis acid ionic liquid catalyst.

The oligomerization is preferably carried out at −10° C. to 300° C., more preferably between 0° C. to 75° C.

A lubricant formulation comprising: a first lubricant base stock of a polyether having a plurality of epoxidized olefin monomeric units, wherein the polyether includes 30 carbon atoms or more; and a second lubricant base stock different than the first lubricant base stock. Preferably, the second base stock includes a mPAO, a PAO, a GTL, a Group I base stock, a Group II base stock, or a Group III base stock.

Further according to the present disclosure, there is a process for making a polyether. The process has the step of oligomerizing in the presence of a catalyst, such as acid catalyst or base catalysts. For example, the process has the step of oligomerizing in the presence of a Lewis acid catalyst an amount of one or more epoxidized olefins to an extent that the polyether has 30 or more carbon atoms.

DETAILED DESCRIPTION

All numerical values within the detailed description and the claims herein are modified by "about" or "approximately" the indicated value, and take into account experimental error and variations that would be expected by a person having ordinary skill in the art.

As used herein, the term "macromer" is defined as a polymeric structure that contains terminal unsaturation (terminal double bond), e.g., ethylene monomer units, propylene monomer units, other alpha-olefin monomer units or combination of those. A macromer is a polymer with a relatively low molecular weight with vinyl, vinylene, or vinylidene terminal olefin. For example, a macromer can be a polymer having a weight average molecular weight ($M_w$) of 20,000 or less, or, more narrowly, 5,000 or less or 2,000 or less. Vinyl-terminated polymers or oligomers, homopolymers and copolymers synthesized from two or more monomers, are known to be useful for post-polymerization (or post-oligomerization) reactions due to the available ethylenic unsaturation at one polymer one chain end or both. Such reactions include functionalization (epoxidation) reactions. Preparation of vinyl-containing macromers is described in U.S. Pat. No. 6,555,635 B2, which is incorporated herein by reference.

Preparation of Vinyl-Containing Stereospecific Polypropylene Macromers and their manufacture is described in WO 9929743, which is incorporated herein by reference.

The macromer can be low molecular weight oligomer of α-olefin that has double bond. For example, dimer of 1-decene prepared via metallocene catalyst.

A polyether-containing base stock is prepared via oligomerization of epoxidized macromers. The disclosure also relates to a process for epoxidation of low molecular weight polymers (macromers) to obtain epoxidized macromers and subsequently oligomerizing such epoxidized macromers to obtain ether segment containing polymers.

An embodiment of a process of the present disclosure is shown by way of example in the following sequence:

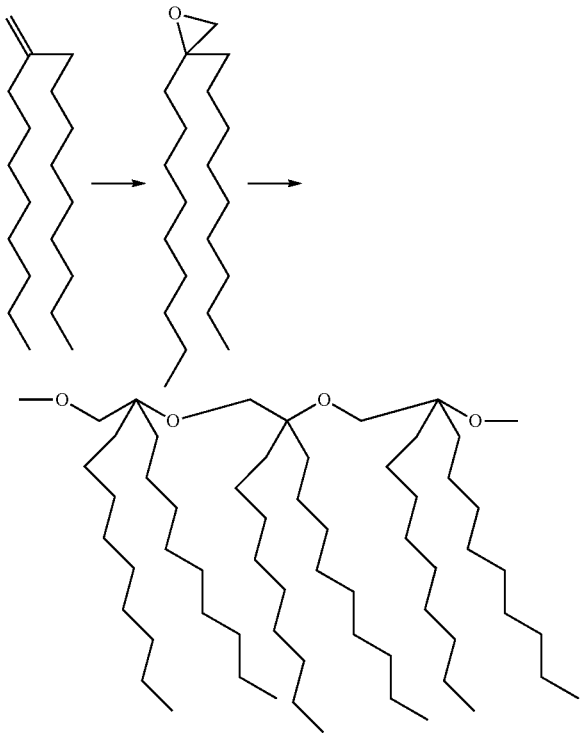

Alpha-olefins are epoxidized using an epoxidation catalyst to produce a terminally epoxidized macromer. Prior to epoxidation, feed olefins are preferably treated to remove catalyst poisons, such as peroxides, oxygen, sulfur, nitrogen-containing organic compounds, and or acetylenic compound as described in WO 2007/011973, which is incorporated herein by reference in its entirety. This treatment is believed to increase catalyst productivity, typically more than five-fold, and, in favorable conditions, more than ten-fold.

Epoxidation of the present olefin materials can be affected using a peracid, such as performic acid, perbenzoic acid or m-chloroperbenzoic acid, as the oxidizing agent. The oxidation reaction can be performed using a preformed peracid to affect the epoxidation, or the peracid can be generated in-situ, for example by the addition of formic acid and hydrogen peroxide to produce performic acid. Formic acid can be added in a molar ratio to the olefin double bonds of from 10:1 to 30:1. Hydrogen peroxide can be added to the reaction mixture in a molar ratio to the olefin double bonds of from 1.01:1 to 5:1. Addition of both formic acid and $H_2O_2$ to the reaction mixture results in the in-situ formation of performic acid as an epoxidizing agent. Typically, the epoxidation is conducted at a temperature ranging from 25° C. to 100° C., preferably from 30° C. to 70° C. Suitable reaction times will generally range from 0.1 hour to 36 hours, such as from 1 hour to 24 hours. Epoxidation reactions can provide conversion from 50 to 100% of the double bonds into oxirane groups.

The epoxidation reaction is generally carried out in a liquid reaction medium. The reaction medium can comprise only the reactants essentially utilized in the process. More conventionally, however, the liquid reaction medium will comprise a suitable reaction solvent in which the reactants and catalyst materials can be dissolved, suspended or dispersed. Suitable reaction solvents include organic liquids which are inert in the reaction mixture. By "inert" is meant that the solvent does not deleteriously affect the oxidation reaction. Suitable inert organic solvents include aromatic hydrocarbons such as benzene, toluene, xylenes, benzonitrile, nitrobenzene, anisole, and phenyl nonane; saturated aliphatic hydrocarbons having from 5 to 20 carbons, such as pentane, hexane, and heptane; adiponitrile; halogenated hydrocarbons such as methylene chloride, 1,2-dichloroethane, chloroform, carbon tetrachloride and the like; non-fluorinated, substituted saturated aliphatic and/or aromatic hydrocarbons having from 1 to 20 carbons, including those selected from the group consisting of alcohols such as methanol, propanol, butanol, isopropanol, and 2,4-di-t-butylphenol; ketones such as acetone; carboxylic acids such as propanoic acid and acetic acid; esters such as ethyl acetate, ethyl benzoate, dimethyl succinate, butyl acetate, tri-n-butyl phosphate, and dimethyl phthalate; ethers, such as tetraglyme; and mixtures thereof.

One type of epoxidation of olefins involves reaction of the material with a peracid, such as performic acid or m-chloroperbenzoic acid, to provide an epoxidized material having oxirane rings formed at the sites of the residual double bonds within the molecule. Catalytic epoxidation alternatives using hydrogen peroxide as an oxidizing agent instead of peracids can be used to epoxidize some unsaturated materials. Catalysts based on the use of high valent (d0), mostly Ti, V, Mo, W, and Re, metal complexes are known to promote alkene epoxidation with $H_2O_2$. Some notable effective epoxidation catalysts for use with hydrogen peroxide include titanium silicates, peroxophosphotungstates, manganese triazocyclononane, and methylrhenium trioxide.

Epoxidation of a broad variety of alkenes, including polymers with double bonds, is in general known in the art. Representative prior art showing various procedures for epoxidizing a number of types of unsaturated materials includes Hafren et al., Macromol. Rapid Commun., Vol. 26, pp. 82-86 (2005); Song et al., J. Polym. Sci. Pofym. Chem., Vol. 40, pp. 1484-1497 (2002); Shigenobu et al. (Maruzen Petrochemical); Japanese Patent Appln. No. JP2001-031716A, published Feb. 26, 2001; Suzuki et al., Journal of Applied Polymer Science, Vol. 72, pp. 103-108 (1999); and Li et al.; Macromolecules, Vol. 38, pp. 6767-6769 (2005). Epoxidation of non-polymeric materials using catalysts or selected reaction medium solvents is also in general known in the art. Representative prior art references showing these kinds of expoxidation includes Hellmann et al., Angew. Chem. Int. Ed.

Engl. Vol. 30, No. 12, pp. 1638-1641 (1991); Van Vliet et al., Chem. Commun., pp. 821-822, (1999); and Neimann et al., Org. Letters, Vol. 2, No. 18, pp. 2861-2863 (2000).

It is possible to use macromers other than dimers in the process of the present disclosure. Other useful macromers include ethylene butylene copolymers, ethylene propylene copolymers, polyethylene, polypropylene polymers having more than $C_{18}$ carbons. Furthermore, epoxidized macromers can be co-oligomerized with α-olefins (such as 1-decene, 1-octene, 1-dodecene, 1-hexene, 1-tetradecene, 1-octadecene or mixtures thereof) or corresponding internal olefins (linear or branched).

The oligomerization or co-oligomerization of the epoxidized macromers can be carried out in the presence of a catalyst of a Lewis acid. The Lewis acid catalysts useful for oligomerization reactions include the metal and metalloid halides conventionally used as Friedel-Crafts catalysts. Suitable examples include $AlCl_3$, $BF_3$, $AlBr_3$, $TiCl_3$, and $TiCl_4$, either as such or with a protic promoter. Other examples include solid Lewis acid catalysts, such as synthetic or natural zeolites; acid clays; polymeric acidic resins; amorphous solid catalysts, such as silica-alumina; and heteropoly acids, such as the tungsten zirconates, tungsten molybdates, tungsten vanadates, phosphotungstates and molybdotungstovanadogermanates (e.g. $WO_x/ZrO_2$ and $WO_x/MoO_3$). Typically, the amount of acid catalyst used is 0.1 to 30 wt % and preferably 0.2 to 5 wt % based on total weight of the feed.

If boron trifluoride is used as the oligomerization catalyst, it is desirable to use a protic promoter. Useful promoters include water; alcohols, such as the lower ($C_1$-$C_6$) alkanols, including ethanol, isopropanol, and butanol; acids, organic acids, such as carboxylic acid, acetic acid, propionic acid, and butanoic acid, or anhydrides thereof, such as acetic anhydride; inorganic acids, such as phosphoric acid as disclosed in U.S. Pat. No. 3,149,178; and esters, such as ethyl acetate as disclosed in U.S. Pat. No. 6,824,671, all of which are incorporated herein by reference in their entirety. Other protic promoters include alcohol alkoxylates, such as glycol ethers, e.g., ethylene glycol monomethyl ether (2-methoxyethanol), and propylene glycol monoethyl ether; ethoxylates derived from mixed $C_2$ to $C_{24}$ straight chain alcohols, such as those described in U.S. Pat. No. 5,068,487, which is incorporated herein by reference in its entirety; ethers, such as dimethyl ether, diethyl ether, and methyl ethyl ether; ketones; aldehydes; and alkyl halides. In the instance of boron trifluoride, the protic promoter forms a catalyst complex with the boron trifluoride, and it is the complex that serves as a catalyst for the oligomerization. The complex usually contains an excess of boron trifluoride, which is adsorbed in the mixture thereof.

The epoxidized macromers that are oligomerized in the presence of the Lewis acid catalyst typically exhibit a number average molecular weight in the range of 120 to 600 with a terminal epoxide content of greater than 25%. It is generally preferable to have an elevated amount of terminal epoxide in the feed.

It is possible to use solvents or diluents in the Lewis acid catalyzed epoxide oligomerization step, but if the catalyst system being used is a liquid, this may also function as the solvent or diluent for the reaction so that no additional solvent or diluent is required. Additional liquids that are non-reactive to the selected catalyst system may, however, be present if desired. For example, additional liquids may be added to control viscosity of the reaction mixture or to carry off heat of reaction by evaporation with reflux of the condensed vapor. Hydrocarbons, such as alkanes and aromatics, e.g., hexane and toluene, are suitable for this purpose. Thus, the light alpha-olefin oligomer reactant, either as such or with additional alpha-olefin co-feed may be oligomerized directly in the presence of the catalyst system with or without the addition of solvent or diluent. The reaction will preferably be carried out in a closed environment when gaseous catalysts such as boron trifluoride are used and preferably under inert atmosphere, e.g. nitrogen.

The temperature of the Lewis acid-catalyzed oligomerization reaction can vary in practical operation between −10° C. to 300° C. and preferably between 0° C. to 75° C. The system may operate under atmospheric pressure since the system typically exhibits low vapor pressures at the temperatures normally used for this process. It may, however, be operated under mild pressure if it is desired to maintain a closed reaction environment, e.g., under autogenous pressure. When using a solid Lewis acid as the catalyst, the oligomerization will preferably be carried out using a fixed bed of the catalyst in a downflow mode, although alternative forms of operation, e.g., in a stirred tank reactor, are possible.

Following completion of the oligomerization reaction, Lewis acid catalyst activity may be quenched by addition of water or a dilute aqueous base, such as 5 wt % NaOH solution. The organic layer may be separated and distilled to remove components other than the base stock. When a promoted $BF_3$ catalyst is used, the gaseous $BF_3$ and promoter may be recycled if not deactivated at the end of the reaction. When a solid catalyst is used, a simple filtration can be used to separate the catalyst from the oligomer product if the reaction has not been carried out in a fixed bed. The oligomer product may then be fractionated to remove any unreacted light olefin and the oligomer in the desired boiling range and can then be hydrogenated to remove residual unsaturation, if desired.

The Lewis acid catalyst used in the present oligomerization process can comprises an ionic liquid. In general the amount of the ionic liquid used as catalyst is typically between 0.1 to 50 wt % and preferably between 0.2 to 5 wt % based on total amount of olefin feed. Most of the ionic liquids are salts (100% ions) with a melting point below 100° C.; they typically exhibit no measurable vapor pressure below thermal decomposition. The properties of ionic liquids result from the composite properties of the wide variety of cations and anions which may be present in these liquids. Many of the ionic liquids are liquid over a wide temperature range (often more than 300° C.). They have low melting points (as low as −96° C. has been reported), which can be attributed to large asymmetric cations having low lattice energies. As a class of materials, ionic liquids are highly solvating for both organic and inorganic materials. Many of them are nonflammable, nonexplosive and have high thermal stability. They are also recyclable, which can be helpful in reducing environmental concerns over their use.

The acidic ionic liquid oligomerization catalyst system will usually be comprised of at least two components of which one is the ionic liquid; in most instances the catalyst system will be a two component system. The first component is an aluminum halide or an alkyl aluminum halide. For example, a typical first component of the catalyst may be aluminum trichloride. The second component is a quaternary ammonium, quaternary phosphonium, or tertiary sulfonium compound, such as, for example, a liquid salt selected from one or more of hydrocarbyl substituted ammonium halides, hydrocarbyl substituted imidazolium halide, hydrocarbyl substituted pyridinium halide, hydrocarbyl substituted phosphonium halide. For example, 1-ethyl-3-methyl-imidazolium chloride can be used as a second component.

The second component making up the catalyst is an ionic liquid which is primarily a salt or mixture of salts which melts below room temperature, as noted above. Ionic liquids may be characterized by the general formula $Q^+A^-$, where is $Q^+$ is quaternary ammonium, quaternary phosphonium or quaternary sulfonium, and $A^-$ is a negatively charged ion such as $Cl^-$, $Br^-$, $OCl_4^-$, $NO_3^-$, $BF_4^-$, $BCl_4^-$, $PF_6^-$, $SbF_6^-$, $AlCl_4^-$, $CuCl_2^-$, $FeCl_3^-$. The mole ratio of the two components of the catalyst system will be usually fall within the range of from 1:1 to 5:1 of the first component to the second component; more preferably the mole ratio will be in the range of from 1:1 to 2:1.

The typical compounds which may be used as the second component of the two component system are at least one selected from the group consisting of: 1-Butyl-3-methylimidazolium hexafluorophosphate [bmim$^+$][$PF_6^-$], Trihexyl (tetradecyl) phosphonium chloride [thtdPh$^+$][$Cl^-$], 1-Ethyl-3-methylimidazolium methanesulfonate [emim$^+$][$CH_3SO_3^-$], 1-Ethyl-3-methylimidazolium thiocyanate [emim$^+$][$SCN^-$], Choline Salicylate, 1-Ethyl-3-methylimidazolium tetrachloroaluminate [emim$^+$][$AlCl_4^-$], 1-Butyl-3-methylimidazolium hexafluorophosphate [bmim][$PF_6^-$], Hexyl-3-methylimidazolium dioctylsulfosuccinate [hmim][doss$^-$], 1-Hexyl-3-methylimidazolium hexafluoroborate [hmim][$BF_4^-$], 1-Hexyl-3-methylimidazolium hexafluorophosphate [hmim][$PF_6^-$], Tetrabutyl ammonium dioctylsulfosuccinate [tbam][doss$^-$], Tetrabutyl phosphonium dioctylsulfosuccinate [tbPh][doss$^-$], Tributyl (tetradecyl) phosphonium dodecylbenzenesulfonate [tbtdPh][dbs$^-$], Tributyl (tetradecyl) phosphonium methanesulfonate [tbtdPh][mes$^-$], Trihexyl (tetradecyl) phosphonium bis(trifluoromethane) sulfonylimide [thtdPh][$Tf_2N^-$], Trihexyl (tetradecyl) phosphonium chloride [thtdPh][$Cl^-$], Trihexyl (tetradecyl) phosphonium decanoate [thtdPh][deca$^-$], Trihexyl (tetradecyl) phosphonium dodecylbenzenesulfonate [thtdPh][dbs$^-$], and Trihexyl (tetradecyl) phosphonium methanesulfonate [thtdPh][mes$^-$].

Following completion of the oligomerization reaction, the organic layer containing the PAO product and the unreacted low molecular weight feed is separated from the ionic liquid phase. The acidic ionic liquid catalyst that remains after recovery of the organic phase may be recycled to the oligomerization reaction.

The feed for epoxidation can contain olefins of virtually any molecular weight but is particularly useful for processing distillate byproducts, i.e., dimers and light fractions, from PAO manufacturing processes. Typically, such a distillate byproduct will have olefin macromers exhibiting a molecular weight ranging from typically 120 to 600 and more typically 140 to 560 (for an average of 200), oligomers of $C_8H_{16}$ to $C_{30}H_{60}$ oligomers (average $C_{20}H_{40}$), and a terminal olefin (vinylidene) content of at least 25%. The molecular weight of the polyether typically ranges from 200 to 20,000, preferably from 300 to 10,000, and most preferably from 350 to 7,500. Higher molecular weights and corresponding viscosities may be achieved by suitable choice of reaction conditions. Values of the polydispersity index (PDI) are typically from between 1 to 3.0.

The terminal olefin content may be as much as 50% to 80% depending on the PAO manufacturing process.

Feeds obtained from distillate byproducts of metallocene-based PAO manufacturing processes are particularly useful in the process of the present disclosure. Such processes are for producing low viscosity PAOs is disclosed in WO2007011973 A1, which is incorporated herein by reference in its entirety. This process usually produces some dimers and light fractions that can not be recycled into the metallocene process thus decreasing total product base stock yields. The metallocene-derived intermediate used as the feed is produced by the oligomerization of an α-olefin feed using a metallocene oligomerization catalyst. The α-olefin feeds used in the initial oligomerization step are typically α-monomers of 4 to 24 carbon atoms, preferably between 6 to 20, and more preferably between 8 to 14 carbon atoms. Examples include 1-butene, 1-hexene, 1-octene, 1-decene, 1-dodecene, and 1-tetradecene. The olefins with even carbon numbers are preferred as are the linear α-olefins although it is possible to use branched-chain olefins containing an alkyl substituent at least two carbons away from the terminal double bond.

Another source of distillate byproduct feeds can be obtained from an alternative metallocene-catalyzed PAO oligomerization process is that disclosed in U.S. Pat. No. 6,548,724, which is incorporated herein by reference in its entirety. Other metallocene polymerization processes that may yield distillate fractions useful as feed for the epoxidation step are described in WO2007011459, WO2007011462, and in U.S. Pat. Nos. 5,017,299 and 5,186,851, which are incorporated herein by reference in their entirety.

Dimers useful as feed for the epoxidation step possess at least one carbon-carbon unsaturated double bond. The unsaturation is usually centrally located at the junction of the two monomer units making up the dimer as a result of the non-isomerizing polymerization mechanism characteristic of metallocene processes. If the initial polymerization step uses a single 1-olefin feed to make an alpha-olefin homopolymer, the unsaturation will be centrally located but if two 1-olefin comonomers have been used to form a copolymer, the location of the double bond may be shifted off center in accordance with the chain lengths of the two comonomers used. In any event, this double bond is vinylic or vinylidenic in character. The amount of unsaturation can be quantitatively measured by bromine number measurement according to ASTM D1159 or equivalent method or according to proton or carbon-13 NMR. Proton NMR spectroscopic analysis can also differentiate and quantify the types of olefinic unsaturation.

The characteristic vinylidene compounds which make up at least 25% of the olefin feed for the present oligomerization process may therefore be defined as unsaturated hydrocarbons of the formula:

$$R^1R^2C{=}CH_2$$

wherein $R^1$ and $R^2$, which may be the same or different, together have from 6 to 40 carbon atoms and $R^1$ is a hydrocarbon group of between 1 to 24 carbon atoms, $R^2$ is $R^1$ or H. Typically, $R^1$ and $R^2$ together have from between 16 to 30 carbon atoms, preferably between 8 to 11 carbon atoms. In the case of dimers prepared from single monomers, $R^1$ and $R^2$ are the same. In preferred dimers, $R^1$ and $R^2$ each have from between 7 to 13 carbon atoms.

The distillate fraction (mostly dimer and trimer) from the PAO oligomerization process may be used as the sole feed material in the present epoxidation and subsequent oligomerization process or it may be used as one of the olefinic feed components for epoxidation and epoxidized molecule can be used together with other α-olefin for the co-oligomerization step. Alpha-olefins or other internal olefins with linear or branched structures, or mixtures of them, may be used for epoxidation and subsequent oligomerization together with low molecular weight α-olefin oligomers as feeds. The distillate fraction α-olefin oligomers may therefore be used as feed for epoxidation and combined with, for example, with a monomeric α-olefin of between 6 to 24 carbon atoms, preferably between 6 to 20 and more preferably between 8 to 14 carbon atoms, preferably olefins with an carbon numbered olefin (such as 1-decene, 1-octene, 1-dodecene, 1-hexene, 1-tetradecene, 1-octadecene or mixtures thereof). The linear alpha-olefins are preferred if optimal lube properties are to be achieved, but it is possible also to use branched-chain olefins containing an alkyl substituent at least two carbons away from the terminal double bond.

The base stocks of the present disclosure are substantially soluble with a variety of conventional base stocks, such as mPAOs, PAOs, GTL, and Visom (Group III) base stocks. Thus, the base stock of the present disclosure can be blended with other base stocks and used in lube applications. Preferred base stocks exhibit a kinematic viscosity at 100° C. of between 3 to 300 cSt, more preferably between 3 to 8 cSt. The base stocks can be used in both high and low temperature lubricant applications.

There are a number of advantages afforded by the process of the present disclosure. One is flexibility in utilizing a previously wasted feedstock, particularly the unfractionated PAO distillate byproduct. Another is the greater reactivity afforded by the terminal olefin in the epoxidized macromer, which affords a product base stock with enhanced physical properties and performance features.

The following are examples of the present disclosure and are not to be construed as limiting.

EXAMPLES

Example 1

Polymerization mPAO Dimer Epoxide

Charged $AlCl_3$ (0.229 g, 0.0017 mole) and 5 ml decane to three-necked round bottom flasks under $N_2$ with agitation via a mechanical stirrer. Added slowly epoxidized mPAO dimer (2-decyl-2-octyloxirane) (5.1 grams, 0.0172 moles) to form a reaction mixture. The reaction mixture was stirred for 72 hours at room temperature. The reaction was stopped by adding 25 ml water and 75 ml methyl tert-butyl ether (MTBE). The MTBE layer was washed with water (2×50 ml) and (1×50 ml) brine until the aqueous layer attained a pH of approximately 7. Then the separated MTBE layer was dried over anhydrous $MgSO_4$ and filtered. The low-boiling MTBE was removed using a rotary evaporator at 65° C. under house vacuum and high boiling components (decane and 2-decyl-2-octyloxirane) with an air bath oven at 160° C.-170° C. under vacuum. The final product yield was 70%. The product IR analysis suggests the formation of 2-decyl-2-octyloxirane homopolymer. The GPC of the polymer gave a monomodal peak with a $M_n$ of 860 and a $M_w$ of 979 using polystyrene standards.

Lube Properties of Base Stocks of Example 1 and Comparative Example 1

The kinematic viscosity (Kv) of the base stock of Example 1 and a base stock of a conventional 6 cSt PAO was measured using ASTM standards D445 and reported for temperatures of 100° C. (Kv at 100° C.) and 40° C. (Kv at 40° C.). The viscosity index (VI) was measured according to ASTM standard D2270 using the measured kinematic viscosities for each product. The viscosity of copolymer was 29.2 cSt at 100° C. and 279.2 cSt at 40° C. with a viscosity index (VI) of 140. The data suggests that the lubricant properties of Example 1 were comparable to that of 6 cSt PAO base stock. The results are set forth in Table 1 below.

TABLE 1

(Lube Properties of Base Stocks)

| Sample # | $Kv_{100}$ | $Kv_{40}$ | Viscosity Index (VI) |
|---|---|---|---|
| Example 1 | 6.49 | 40.28 | 113 |

TABLE 1-continued (Lube Properties of Base Stocks)

| Sample # | $Kv_{100}$ | $Kv_{40}$ | Viscosity Index (VI) |
|---|---|---|---|
| Comp. Ex. 1 (6 cSt PAO 6)* | 5.8 | 31 | 138 |

*not an example of the present disclosure

Friction Coefficients of Base Stocks of Example 1 and Comparative Example 1

The friction coefficients of the base stock of Example 1 and a base stock of a conventional 6 cSt PAO were measured using a high frequency reciprocating rig (HFRR) test at the following conditions: speed: 0.1 meter/second (60 Hz), temp: 100° C., pressure: 1 GPa (500 grams), duration: 4 hours). The friction coefficient of Example 1 was 0.09 while the friction coefficient of a 6 cSt PAO was 0.19. This substantial difference in friction coefficient reflects the advantageous energy efficiency of the base stock of Example 1. The friction coefficients are set forth below in Table 2.

TABLE 2

(The Friction Coefficient of Base Stocks)

| Sample # | Friction Coefficient (HFRR test) |
|---|---|
| Example 1 | 0.09 |
| Comp. Ex. 1 (6 cSt PAO 6)* | 0.19 |

The base stock of Example 1 is soluble with a variety of conventional base stocks, such as mPAOs, PAOs, GTL, and Visom (Gr. III) base stocks. Thus, the base stock of Example 1 can be blended with other base stocks and used for lube applications.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variances which fall within the scope of the appended claims.

Applicants have attempted to disclose all forms and applications of the disclosed subject matter that could be reasonably foreseen. However, there may be unforeseeable, insubstantial modifications that remain as equivalents. While the present disclosure has been described in conjunction with specific, exemplary forms thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. All numerical values within the detailed description and the claims herein are also understood as modified by "about."

What is claimed is:

1. A lubricant base stock comprising a polyether prepared from epoxidized olefin monomeric units, wherein the polyether includes repeating quaternary carbon atoms in the polyether backbone wherein each repeating quaternary carbon atom includes two alkyl groups having together from 6 to 40 carbon atoms.

2. The base stock of claim 1, wherein the epoxidized olefin monomeric units are an epoxidized macromer having between 18 to 40 carbon atoms derived from ethylene, propylene or α-olefins, and combinations of the foregoing.

3. The base stock of claim 1, wherein the epoxidized olefin monomeric unit is derived from one or more internal olefins.

4. The base stock of claim 1, wherein the epoxidized olefin monomeric unit is a low molecular weight oligomer prepared via a metallocene catalytic reaction.

5. The base stock of claim 4, wherein said low molecular weight oligomer is a dimer of 1-decene, 1-decene, 1-hexene, 1-tetradecene or mixtures thereof.

6. The base stock of claim 1, wherein the polyether includes 30 carbon atoms to 1000 carbon atoms.

7. The base stock of claim wherein the base stock exhibits a kinematic viscosity at 100° C. of 3 to 600 cSt.

8. The base stock of claim 1, vherein the base stock exhibits a kinematic viscosity at 100° C. of between 3 to 8 cSt.

9. A process for making polyether comprising oligomerizing in the presence of a Lewis acid catalyst an amount of one or more epoxidized olefins, wherein the polyether includes repeating quaternary carbon atoms in the polyether backbone wherein each repeating quaternary carbon atom includes two alkyl groups having together from 6 to 40 carbon atoms.

10. The process of claim 9, wherein the one or more epoxidized olefins have between 18 to 40 carbon atoms derived from ethylene, propylene or α-olefins, and combinations of the foregoing.

11. The process of claim 9, wherein the one or more epoxidized olefins are derived from one or more internal olefins.

12. The process of claim 9, wherein the one or more epoxidized olefins are derived from one or more olefins including hexene, octene, nonene, octene, decene, undecene, dodecene, tetradecene, or octadecene.

13. The process of claim 9, wherein the one or more epoxidized olefins are a low molecular weight oligomer prepared via a metallocene catalytic reaction.

14. The process of claim 13, wherein said low molecular weight oligomer is a dimer of 1-decene, 1-decene, 1-hexene, 1-tetradecene or mixtures thereof.

15. The process of claim 9, wherein the polyether includes 30 carbon atoms to 1000 carbon atoms.

16. The process of claim 9, wherein the Lewis acid includes $AlCl_3$, $BF_3$, $AlBr_3$, $TiCl_3$, or $TiCl_4$, or Lewis acid ionic liquid catalyst.

17. The process of claim 9, wherein the oligomerization is carried out at −10° C. to 300° C.

18. The process of claim 9, wherein the oligomerization is carried out at 0° C. to 75° C.

19. A lubricant formulation comprising:

a first lubricant base stock of a polyether prepared from epoxidized olefin monomeric units, wherein the polyether includes repeating quaternary carbon atoms in the polyether backbone wherein each repeating quaternary carbon atom includes two alkyl groups having together from 6 to 40 carbon atoms; and a second lubricant base stock different than said first lubricant base stock.

20. The formulation of claim 19, wherein the second base stock includes a mPAO, a PAO, a GTL, a Group I base stock, a Group II base stock, or a Group III base stock.

* * * * *